US008553057B2

(12) United States Patent
Ho

(10) Patent No.: US 8,553,057 B2
(45) Date of Patent: Oct. 8, 2013

(54) FIXING MECHANISM FOR FIXING A THERMAL PRINT HEAD MODULE IN DIFFERENT POSITIONS AND THERMAL SUBLIMATION PRINTER THEREWITH

(75) Inventor: Ming-Chun Ho, New Taipei (TW)

(73) Assignee: HiTi Digital, Inc., Xindian Dist., New Taipei (TW)

( * ) Notice: Subject to any disclaimer, the term of this patent is extended or adjusted under 35 U.S.C. 154(b) by 0 days.

(21) Appl. No.: 13/485,942

(22) Filed: Jun. 1, 2012

(65) Prior Publication Data

US 2013/0176372 A1 Jul. 11, 2013

(30) Foreign Application Priority Data

Jan. 5, 2012 (TW) ..... 101100456 A

(51) Int. Cl.
*B41J 2/335* (2006.01)

(52) U.S. Cl.
USPC ..... 347/197

(58) Field of Classification Search
USPC ..... 347/197, 198; 400/120.16, 120.17
See application file for complete search history.

(56) References Cited

U.S. PATENT DOCUMENTS

| | | | | |
|---|---|---|---|---|
| 8,194,108 | B1 * | 6/2012 | Long et al. | 347/197 |
| 8,405,697 | B2 * | 3/2013 | Tsuchiya et al. | 347/197 |
| 2005/0135858 | A1 * | 6/2005 | Untersteller et al. | 400/120.16 |

* cited by examiner

*Primary Examiner* — Kristal Feggins
(74) *Attorney, Agent, or Firm* — Winston Hsu; Scott Margo

(57) ABSTRACT

A fixing mechanism for fixing a thermal print head module is disclosed. The thermal print head module is pivoted to a casing. The fixing mechanism includes a base, a linkage member and a plurality of positioning structures. The base is disposed on the casing. The linkage member is pivoted to the base and the thermal print head module. The linkage member is driven by the thermal print head module when the thermal print head module is rotated relative to the casing, such that the linkage member is pivoted to different positions relative to the base. The plurality of the positioning structures is disposed on the linkage member for fixing the linkage member, so as to position the thermal print head module in corresponding positions.

10 Claims, 7 Drawing Sheets

FIXING MECHANISM FOR FIXING A THERMAL PRINT HEAD MODULE IN DIFFERENT POSITIONS AND THERMAL SUBLIMATION PRINTER THEREWITH

BACKGROUND OF THE INVENTION

1. Field of the Invention

The present invention relates to a fixing mechanism and a thermal sublimation printer therewith, and more particularly, to a fixing mechanism for fixing a thermal print head module in different positions and a thermal sublimation printer therewith.

2. Description of the Prior Art

Generally speaking, a conventional thermal sublimation printer includes a thermal print head module. When the thermal sublimation printer is turned off, the thermal print head module is located in a standby position. When the thermal sublimation printer is turned on for printing images, the thermal print head module can reach a print position from the standby position rapidly, so as to perform following operations, such as thermal printing and so on. Furthermore, when the thermal sublimation printer is required to replace the thermal print head module, the thermal print head module can reach an initial position for a user to fix or replace the thermal print head module conveniently.

However, if the thermal sublimation printer is suddenly powered off during fixing or replacement process, the thermal print head module will be located in the initial position. Or the thermal print head module is located in the standby position when the thermal sublimation printer is turned off. The above-mentioned situations cause collisions between the thermal print head module and other internal components of the thermal sublimation printer due to vibration generated by the thermal sublimation printer when the thermal sublimation printer is transported, resulting in damages of the thermal print head module. In order to solve the aforesaid problems, a plurality of fixing mechanisms, such as mechanisms of cams and hooks, is used for fixing the thermal print head module in the above-mentioned positions, resulting in not only increase of costs but also occupation of internal mechanical space.

SUMMARY OF THE INVENTION

The present invention provides a fixing mechanism for fixing a thermal print head module in different positions and a thermal sublimation printer therewith for solving above drawbacks.

According to the claimed invention, a fixing mechanism for fixing a thermal print head module of a thermal sublimation printer in different positions is disclosed. The thermal print head module is pivoted to a casing of the thermal sublimation printer. The fixing mechanism includes a base, a linkage member and a plurality of positioning structures. The base is disposed on the casing. The linkage member is pivoted to the base and the thermal print head module, and the linkage member is driven by the thermal print head module when the thermal print head module is rotated relative to the casing, such that the linkage member is pivoted to different positions relative to the base. The plurality of positioning structures is disposed on the linkage member for fixing the linkage member, so as to position the thermal print head module in the corresponding positions.

According to the claimed invention, the plurality of positioning structures includes a first positioning structure and a second positioning structure. The first positioning structure is for fixing the thermal print head module when the thermal print head module is rotated to a first position relative to the casing, so as to position the thermal print head module in the first position. The second positioning structure is for fixing the thermal print head module when the thermal print head module is rotated to a second position relative to the casing, so as to position the thermal print head module in the second position.

According to the claimed invention, the fixing mechanism further includes a locking module. The locking module is disposed on the thermal print head module and rotating with the thermal print head. The locking module is for fixing the thermal print head module cooperatively with the first positioning structure when the thermal print head module is rotated to the first position relative to the casing, so as to position the thermal print head module in the first position. The locking module is further for fixing the thermal print head module cooperatively with the second positioning structure when the thermal print head module is rotated to the second position relative to the casing, so as to position the thermal print head module in the second position.

According to the claimed invention, the locking module includes a pin, an electromagnetic assembly and a resilient member. The pin is for inserting into the first positioning structure or the second positioning structure. The electromagnetic assembly is for attracting the pin, such that the pin is separated from the first positioning structure or from the second positioning structure in a first direction. The resilient member abuts against the pin and the electromagnetic assembly for driving the pin to move in a second direction opposite to the first direction, such that the pin inserts into the first positioning structure or the second positioning structure, so as to position the thermal print head module in the corresponding first position or the second position.

According to the claimed invention, a slot is formed on the linkage member for engaging with a shaft of the thermal print head module, such that the shaft moves along the slot when the thermal print head module drives the linkage member to rotate relative to the base.

According to the claimed invention, a thermal sublimation printer includes a casing, a thermal print head module and a fixing mechanism. The thermal print head module is pivoted to the casing. The fixing mechanism is for fixing a thermal print head module in different positions. The fixing mechanism includes a base, a linkage member and a plurality of positioning structures. The base is disposed on the casing. The linkage member is pivoted to the base and the thermal print head module, and the linkage member is driven by the thermal print head module when the thermal print head module is rotated relative to the casing, such that the linkage member is pivoted to different positions relative to the base. The plurality of positioning structures is disposed on the linkage member for fixing the linkage member, so as to position the thermal print head module in the corresponding positions.

In summary, the present invention can fix the linkage member in different positions by utilizing one set of the positioning structures of the single fixing mechanism and the pin of the locking module, so as to fix the thermal print head module in the corresponding position. For example, when the thermal sublimation printer is turned on, the thermal print head module is rotated to the first position. In the meanwhile, the pin of the locking module inserts into the first positioning structure of the fixing mechanism, so as to position the thermal print head module in the first position. When the thermal print head module of the thermal sublimation printer is required to be replaced, the thermal print head module is rotated to the second position. In the meanwhile, the pin of the locking module inserts into the second positioning structure of the fixing mechanism, so as to position the thermal print head module in the second position. In such a manner, no matter when the thermal print head module is located in the first position or when the thermal print head module is located in the second position, the thermal print head module can be positioned inside the thermal sublimation printer. Accordingly, the fixing mechanism of the present invention can prevent the thermal print head module from collisions between the thermal print head module and other internal components of the thermal sublimation printer due to fierce vibration generated by the thermal sublimation printer when the thermal sublimation printer is transported, so as to prevent the thermal print head module from damage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
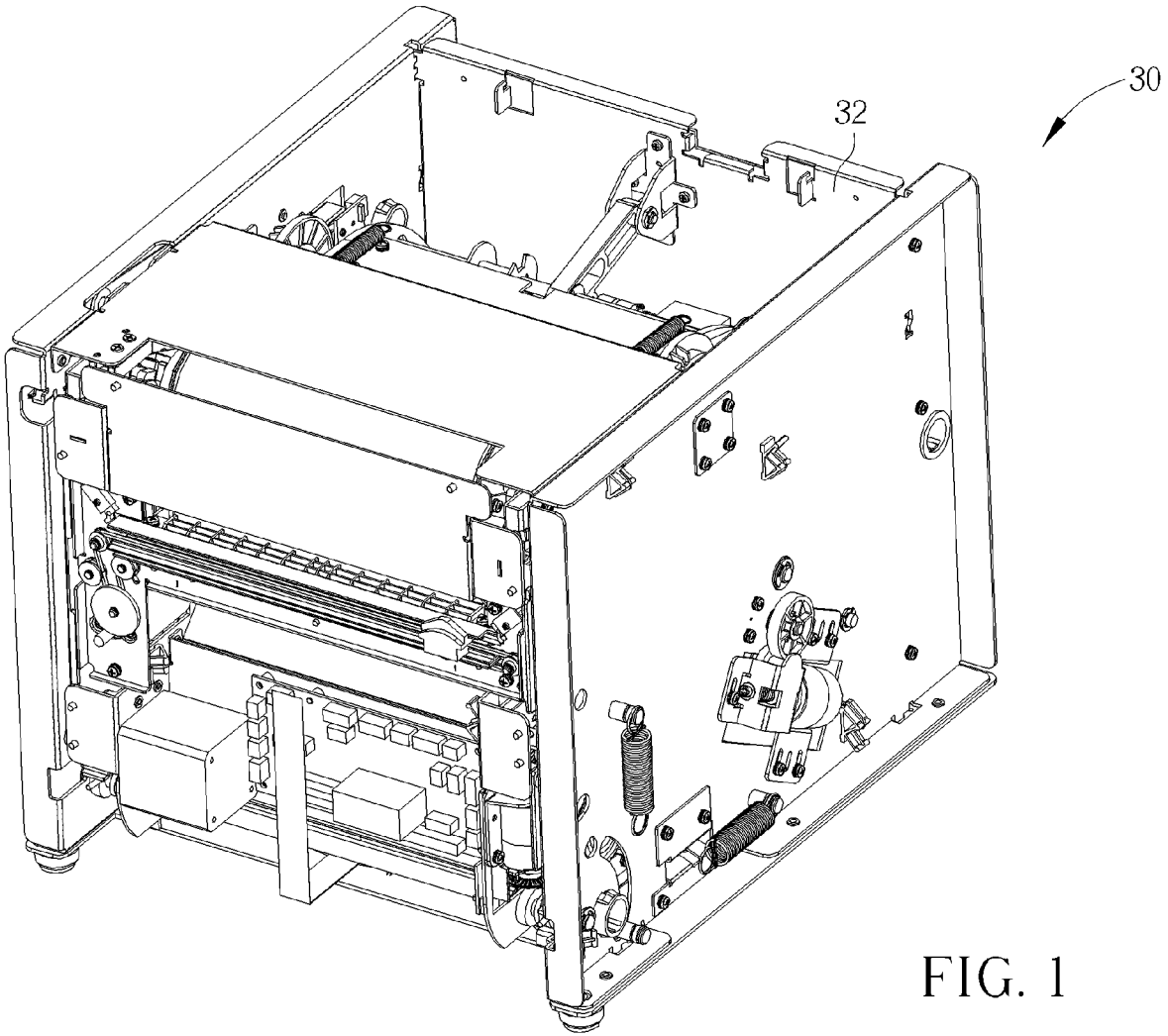
FIG. 1 is an internal diagram of a thermal sublimation printer according to a preferred embodiment of the present invention.
Figure 2:
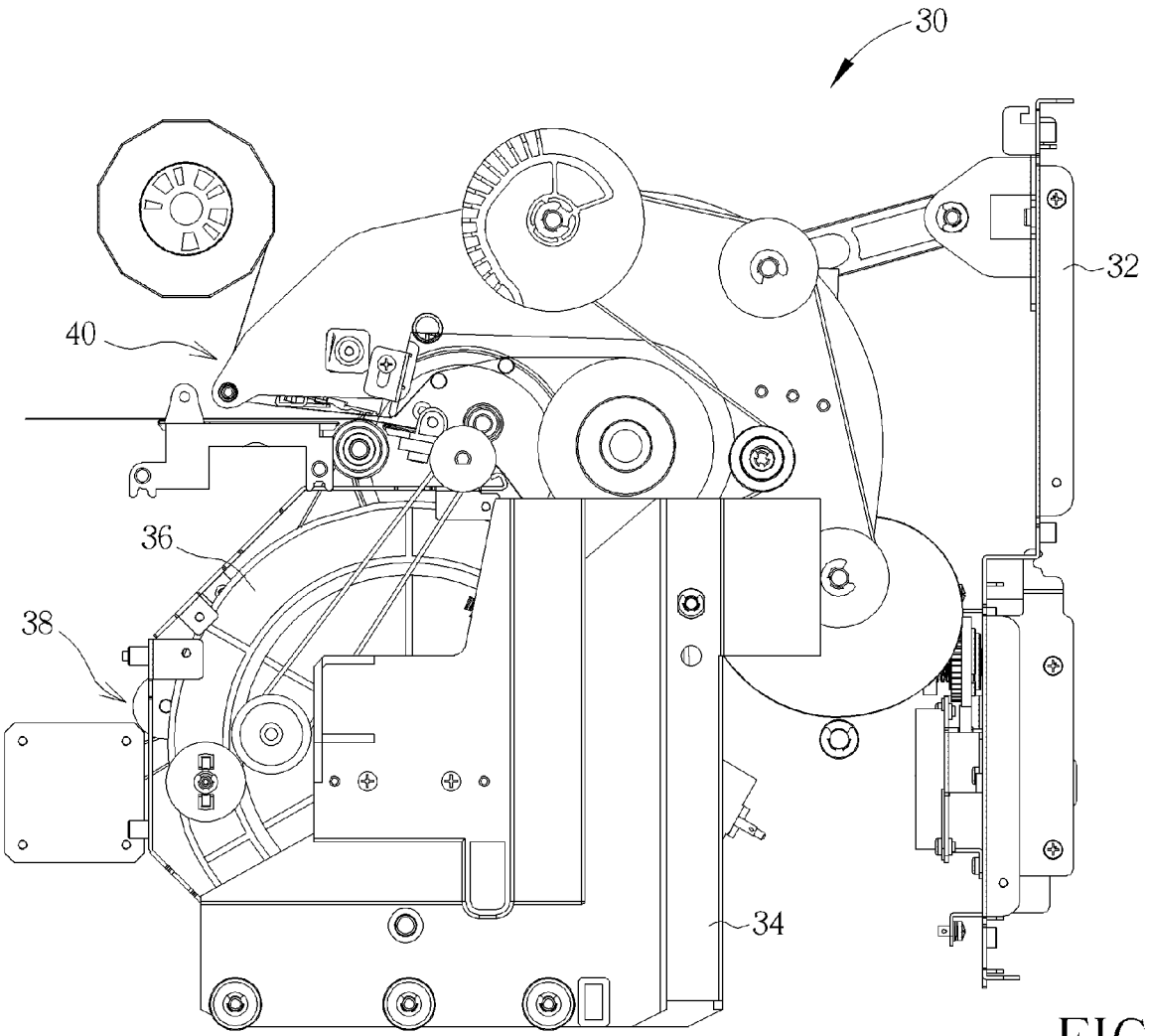
FIG. 2 is a diagram illustrating an internal mechanism of the thermal sublimation printer according to the preferred embodiment of the present invention.

Please refer to FIG. 1 and FIG. 2. FIG. 1 is an internal diagram of a thermal sublimation printer 30 according to a preferred embodiment of the present invention. FIG. 2 is a diagram illustrating an internal mechanism of the thermal sublimation printer 30 according to the preferred embodiment of the present invention. As shown in FIG. 1 and FIG. 2, the thermal sublimation printer 30 includes a casing 32 and a supporting member 34. The supporting member 34 can be disposed on a bottom of the casing 32 for holding a print medium 36, such as a paper roll and so on. The thermal sublimation printer 30 further includes a feeding mechanism 38 and a thermal print head module 40. The feeding mechanism 38 is used for transporting the print medium 36 to the thermal print head module 40, such that the thermal print head module 40 performs following operations, such as thermal printing and so on, so as to form an image onto the print medium 36.

Figure 3:
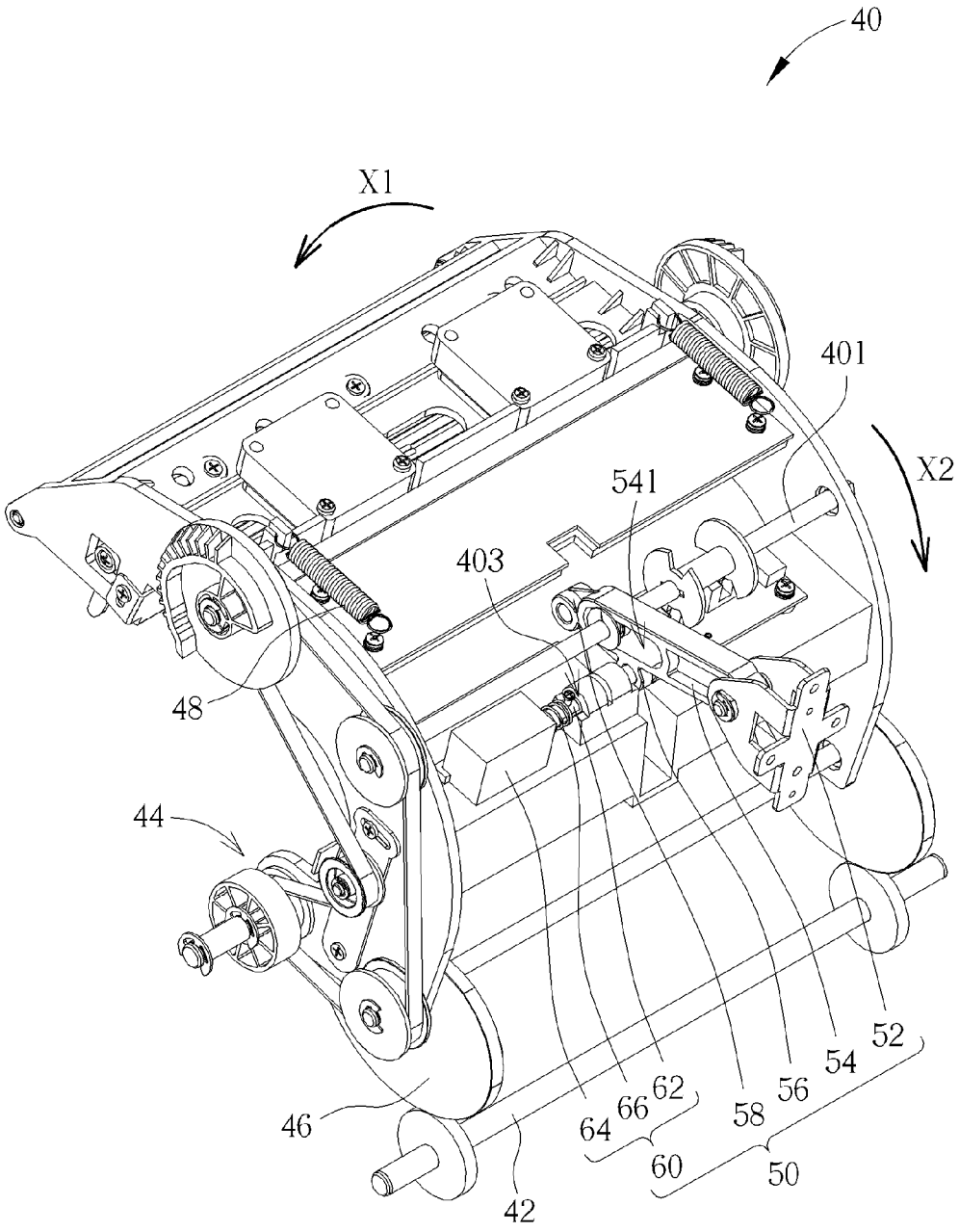
FIG. 3 is a diagram of a thermal print head module in a first status according to the preferred embodiment of the present invention.
Figure 4:
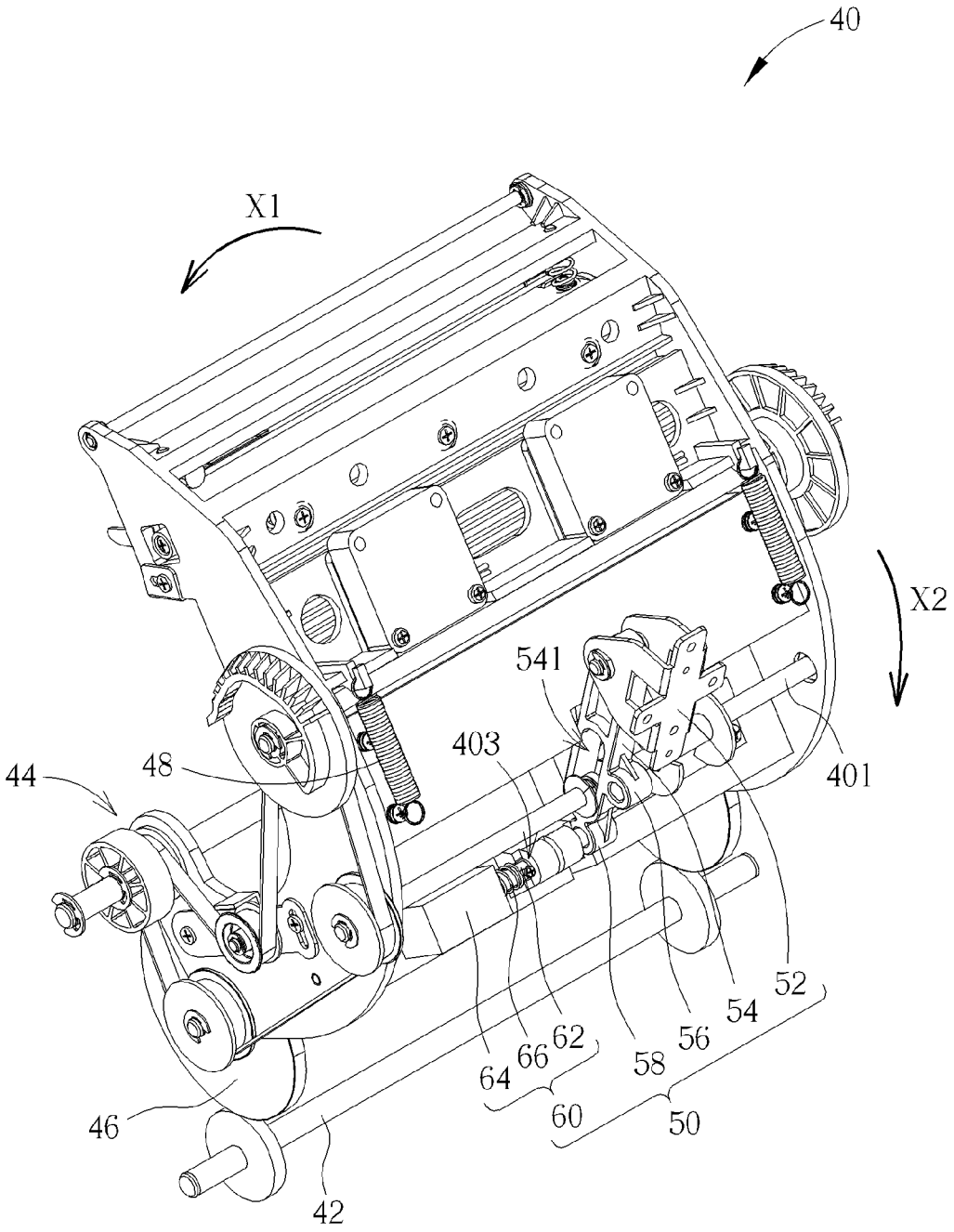
FIG. 4 is a diagram of the thermal print head module in a second status according to the preferred embodiment of the present invention.

Please refer to FIG. 3 and FIG. 4. FIG. 3 is a diagram of the thermal print head module 40 in a first status according to the preferred embodiment of the present invention. FIG. 4 is a diagram of the thermal print head module 40 in a second status according to the preferred embodiment of the present invention. As shown in FIG. 3 and FIG. 4, the thermal sublimation printer 30 further includes a long shaft member 42, a transmission mechanism 44 and a cam member 46. The long shaft member 42 is connected to a fixing member, such as the casing 32 of the thermal sublimation printer 30. The cam member 46 is connected to the transmission mechanism 44 and abuts against the long shaft member 42, and the thermal print head module 40 is capable of rotating with the cam member 46. When the transmission mechanism 44 is driven by a motor (not shown in figures), the cam member 46 is driven by the transmission mechanism 44 to rotate relative to the long shaft member 42. In the meanwhile, the thermal print head module 40 is rotated with the cam member 46 relative to the long shaft member 42 from a second position shown in FIG. 4 to a first position shown in FIG. 3 in a first rotation direction X1.

In addition, the thermal sublimation printer 30 further includes at least one resilient member 48. The at least one resilient member 48 is used for providing a resilient force when the motor activates reversely, so as to drive the thermal print head module 40 to rotate with the cam member 46 relative to the long shaft member 42 from the first position shown in FIG. 3 to the second position shown in FIG. 4 in a second rotation direction X2 opposite to the first rotation direction X1. In this embodiment, the resilient member 48 can be preferably a spring, and the thermal sublimation printer 30 can include two resilient members 48 respectively disposed in positions corresponding to two sides of the thermal print head module 40. It should be noticed that an amount and disposal positions of the resilient member 48 are not limited to those mentioned above. For example, the thermal sublimation printer 30 can include only one resilient member 48 which is disposed in a position corresponding to the middle portion of the thermal print head module 40. In other words, the amount and disposal positions of the resilient member 48 capable of providing the resilient force when the motor activates reversely, so as to drive the thermal print head module 40 to rotate in the second rotation direction X2 are within the scope of the present invention.

In summary, since the long shaft member 42 is connected to the casing 32 and the thermal print head module 40 can be rotated relative to the long shaft member 42 between the first position and the second position by the transmission mechanism 44, the cam member 46 and the resilient member 48, the thermal print head module 40 is rotated relative to the casing 32 as being rotated relative to the long shaft member 42. In practical application, the aforesaid first position can be a standby position when the thermal print head module 40 is turned on. When the thermal sublimation printer 30 is turned on for printing images, the thermal print head module 40 can reach a print position from the standby position rapidly, so as to perform following operations, such as thermal printing and so on. Furthermore, when the thermal sublimation printer 30 is required to replace the thermal print head module 40, the thermal print head module 40 can reach an initial position for a user to fix or replace the thermal print head module 40 conveniently.

In addition, the thermal sublimation printer 30 further includes a fixing mechanism 50 for fixing the thermal print head module 40 in the first position or in the second position, respectively. The fixing mechanism 50 includes a base 52. The base 52 can be, but not limited to, disposed on the casing 32 of the thermal sublimation printer 30. For example, the base 52 can also be disposed on other fixing structure, such as a fixing metal plate, of the thermal sublimation printer 30, or the base 52 and the casing 32 can be integrally formed as well. As for which one of the above-mentioned designs is adopted, it depends on practical demands. The fixing mechanism 50 further includes a linkage member 54 pivoted to the base 52 and the thermal print head module 40. When the thermal print head module 40 is driven by the transmission mechanism 44 to rotate relative to the casing 32 to the first position or to the second position, the linkage member 54 can be driven by the thermal print head module 40 to rotate relative to the base 52 to the corresponding first position or the second position.

Figure 5:
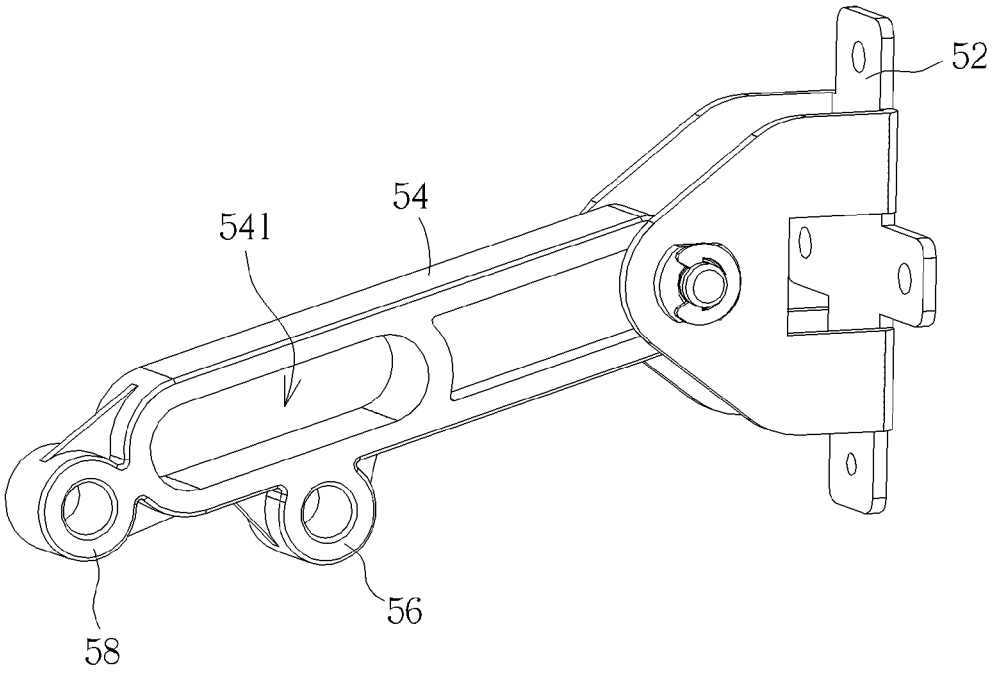
FIG. 5 is a diagram of a base and a linkage member according to the preferred embodiment of the present invention.

Please refer to FIG. 3 to FIG. 5. FIG. 5 is a diagram of the base 52 and the linkage member 54 according to the preferred embodiment of the present invention. As shown in FIG. 3 to FIG. 5, the thermal print head module 40 includes a shaft 401, and a slot 541 is formed on the linkage member 54. The slot 541 on the linkage member 54 is used for engaging with the shaft 401 of the thermal print head module 40. When the linkage member 54 of the fixing mechanism 50 is driven by the thermal print head module 40 to rotate relative to the base 52, the shaft 401 can move along the slot 541 on the linkage member 54. In such a manner, when the linkage member 54 of the fixing mechanism 50 is rotated relative to the base 52, the thermal print head module 40 is capable of rotating relative to the casing 32, simultaneously. In other words, the shaft 401 and the slot 541 are used for allowing the thermal print head module 40 and the linkage member 54 to respectively rotate relative to the thermal print head module 40 and the linkage member 54 without interference.

Figure 6:
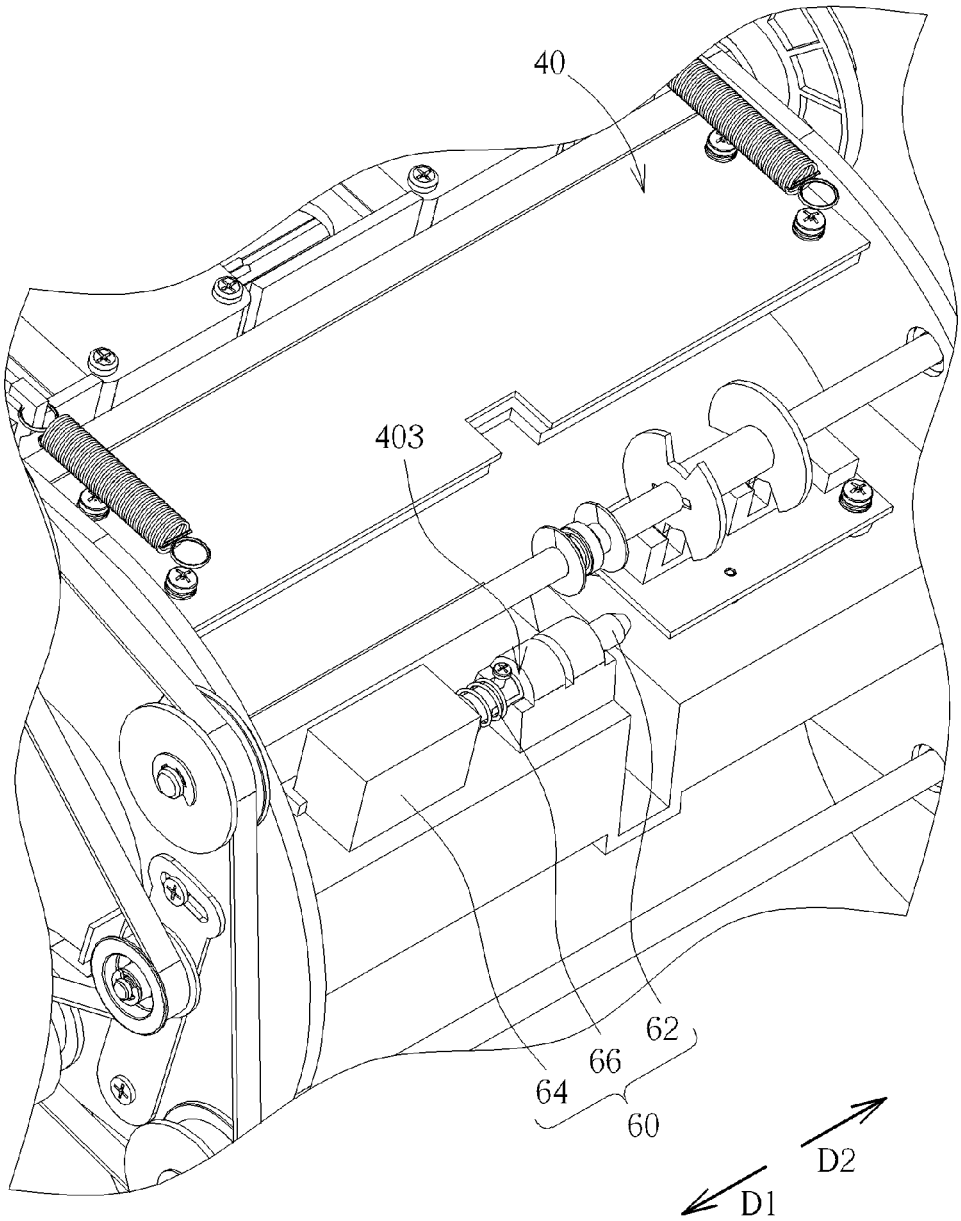
FIG. 6 is a diagram of a locking module in a locked status according to the preferred embodiment of the present invention.

In addition, the fixing mechanism 50 further includes a first positioning structure 56 and a second positioning structure 58. The first positioning structure 56 and the second positioning structure 58 are respectively disposed on the linkage member 54, as shown in FIG. 5. Furthermore, the fixing mechanism 50 further includes a locking module 60. The locking module 60 is disposed on the thermal print head module 40 and rotating with the thermal print head module 40, as shown in FIG. 3 and FIG. 4. Please refer to FIG. 6. FIG. 6 is a diagram of the locking module 60 in a locked status according to the preferred embodiment of the present invention. As shown in FIG. 6, the locking module 60 includes a pin 62, an electromagnetic assembly 64 and a resilient member 66. The pin 62 is movably disposed through a through hole 403 on the thermal print head module 40, such that the pin 62 is capable of stably moving by the through hole 403. The electromagnetic assembly 64 is used for attracting the pin 62, such that the pin 62 is capable of moving on the thermal print head module 40 in a first direction D1 by the through hole 403. The resilient member 66 abuts against the pin 62 and the electromagnetic assembly 64 for driving the pin 62 to move on the thermal print head module 40 in a second direction D2 opposite to the first direction D1 by the through hole 403. In this embodiment, the resilient member 66 can be preferably a spring.

Figure 7:
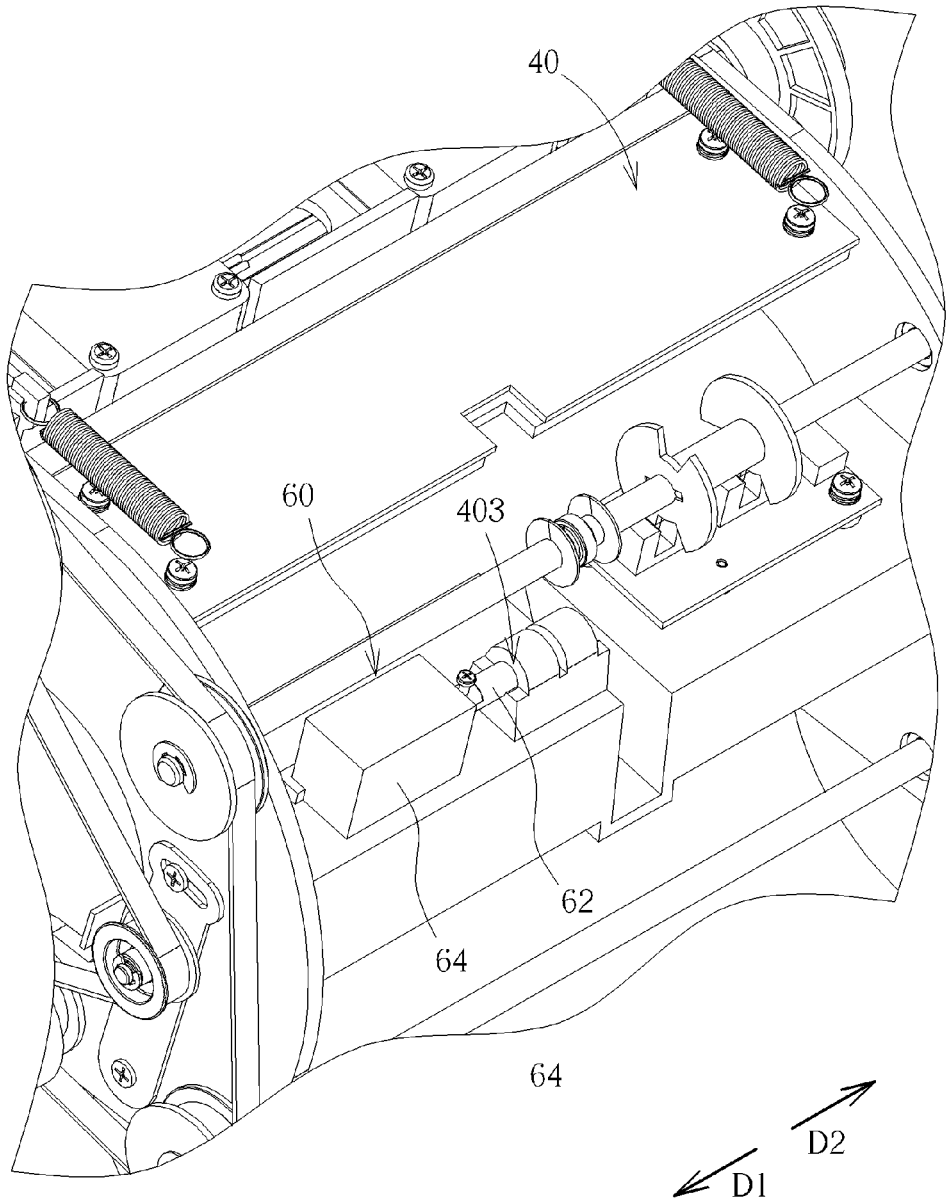
FIG. 7 is a diagram of the locking module in a released status according to the preferred embodiment of the present invention.

Please refer to FIG. 3 to FIG. 7. FIG. 7 is a diagram of the locking module 60 in a released status according to the preferred embodiment of the present invention. As shown in FIG. 3 to FIG. 7, when the thermal sublimation printer 30 is turned on, the electromagnetic assembly 64 of the locking module 60 is activated for attracting the pin 62, such that the pin 62 is attracted to move to a released position shown in FIG. 7 in the first direction D1. In the meanwhile, the pin 62 of the locking module 60 is separated from the first positioning structure 56 or from the second positioning structure 58, so as to release the thermal print head module 40. Furthermore, when the pin 62 is moved from the released position, the pin 62 compresses the resilient member 66 simultaneously, such that the resilient member 66 stores a resiliently potential energy. In the meanwhile, the thermal print head module 40 can be driven by the transmission mechanism 44 to rotate relative to the casing 32 in the first rotation direction X1 to the first position shown in FIG. 3.

Furthermore, the linkage member 54 of the fixing mechanism 50 is driven by the thermal print head module 40 to a position corresponding to the first position. In other words, the first positioning structure 56 of the fixing mechanism 50 is aimed at the pin 62 of the locking module 60 at the same time. Afterwards, when the thermal sublimation printer 30 is desired to be used for printing images, the thermal print head module 40 can reach the print position from the first position rapidly, so as to perform the following operations, such as thermal printing and so on. If the thermal print head module 40 is not used to print the image immediately, the electromagnetic assembly 64 of the locking module 60 stops attracting the pin 62 after the thermal sublimation printer 30 stands by for a predetermined period. In other words, an attractive force of the electromagnetic assembly 64 for the pin 62 disappears. Accordingly, the resilient member 66 releases the resiliently potential energy and generates a resilient force, so as to drive the pin 62 to move to a released position shown in FIG. 6 in the second direction D2. In the meanwhile, the pin 62 of the locking module 60 can insert into the first positioning structure 56 of the fixing mechanism 50. In such a manner, the pin 62 of the locking module 60 can fix the thermal print head module 40 cooperatively with the first positioning structure 56 of the fixing mechanism 50, so as to position the thermal print head module 40 in the first position, as shown in FIG. 3.

On the other hand, when the thermal print head module 40 of the thermal sublimation printer 30 is desired to be replaced, the electromagnetic assembly 64 of the locking module 60 is activated for attracting the pin 62, such that the pin 62 moves to the released position shown in FIG. 7 in the first direction D1. In the meanwhile, the pin 62 of the locking module 60 can be separated from the first positioning structure 56 of the fixing mechanism 50 and moved to the released position shown in FIG. 7, so as to release the thermal print head module 40. Furthermore, when the pin 62 is moved to the released position, the pin 62 compresses the resilient member 66 simultaneously, such that the resilient member 66 stores the resiliently potential energy. In the meanwhile, the thermal print head module 40 can be driven by the transmission mechanism 44 to rotate relative to the casing 32 in the second rotation direction X2 to the second position shown in FIG. 4. Furthermore, the linkage member 54 of the fixing mechanism 50 is driven by the thermal print head module 40 to a position corresponding to the second position. In other words, the second positioning structure 58 of the fixing mechanism 50 is aimed at the pin 62 of the locking module 60 at the same time. Afterwards, the electromagnetic assembly 64 of the locking module 60 stops attracting the pin 62. In other words, the attractive force of the electromagnetic assembly 64 for the pin 62 disappears. Accordingly, the resilient member 66 releases the resiliently potential energy and generates the resilient force, so as to drive the pin 62 to move to the locked position shown in FIG. 6 in the second direction D2. In the meanwhile, the pin 62 of the locking module 60 can insert into the second positioning structure 58 of the fixing mechanism 50. In such a manner, the pin 62 of the locking module 60 can fix the thermal print head module 40 cooperatively with the second positioning structure 58 of the fixing mechanism 50, so as to position the thermal print head module 40 in the second position, as shown in FIG. 4.

It should be noticed that an amount of the positioning structures of the fixing mechanism 50 is not limited to that mentioned above. In other words, the fixing mechanism 50 can include a plurality of the fixing mechanisms 50, such as three fixing mechanisms 50, four fixing mechanisms 50 and so on, and it depends on practical demands. When the linkage member 54 of the fixing mechanism 50 is driven by the thermal print head module 40 to rotate to different positions, the plurality of positioning structures of the fixing mechanism 50 can fix the linkage member 54 in different positions cooperatively with the pin 62 of the locking module 60, so as to position the thermal print head module 40 in the corresponding positions.

Compared to the prior art, the present invention can fix the linkage member in different positions by utilizing one set of the positioning structures of the single fixing mechanism and the pin of the locking module, so as to fix the thermal print head module in the corresponding position. For example, when the thermal sublimation printer is turned on, the thermal print head module is rotated to the first position, i.e. the standby position. In the meanwhile, the pin of the locking module inserts into the first positioning structure of the fixing mechanism, so as to position the thermal print head module in the first position. When the thermal print head module of the thermal sublimation printer is required to be replaced, the thermal print head module is rotated to the second position, i.e. the initial position. In the meanwhile, the pin of the locking module inserts into the second positioning structure of the fixing mechanism, so as to position the thermal print head module in the second position. In such a manner, no matter the thermal print head module is located in the first position when the thermal sublimation printer is powered off right after the thermal print head module is fixed or replaced, or the thermal print head module is located in the second position when the thermal sublimation printer is turned off, the thermal print head module can be positioned inside the thermal sublimation printer. Accordingly, the fixing mechanism of the present invention can prevent the thermal print head module from collisions between the thermal print head module and other internal components of the thermal sublimation printer due to fierce vibration generated by the thermal sublimation printer when the thermal sublimation printer is transported, so as to prevent the thermal print head module from damage.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A fixing mechanism for fixing a thermal print head module of a thermal sublimation printer in different positions, the thermal print head module being pivoted to a casing of the thermal sublimation printer, the fixing mechanism comprising:

a base disposed on the casing;

a linkage member pivoted to the base and the thermal print head module, the linkage member being driven by the thermal print head module when the thermal print head module is rotated relative to the casing, such that the linkage member is pivoted to different positions relative to the base; and a plurality of positioning structures disposed on the linkage member for fixing the linkage member, so as to position the thermal print head module in the corresponding positions.

2. The fixing mechanism of claim 1, wherein the plurality of positioning structures comprises:

a first positioning structure for fixing the thermal print head module when the thermal print head module is rotated to a first position relative to the casing, so as to position the thermal print head module in the first position; and a second positioning structure for fixing the thermal print head module when the thermal print head module is rotated to a second position relative to the casing, so as to position the thermal print head module in the second position.

3. The fixing mechanism of claim 2, further comprising:

a locking module disposed on the thermal print head module and rotating with the thermal print head module, the locking module being for fixing the thermal print head module cooperatively with the first positioning structure when the thermal print head module is rotated to the first position relative to the casing, so as to position the thermal print head module in the first position, the locking module being further for fixing the thermal print head module cooperatively with the second positioning structure when the thermal print head module is rotated to the second position relative to the casing, so as to position the thermal print head module in the second position.

4. The fixing mechanism of claim 3, wherein the locking module comprises:

a pin for inserting into the first positioning structure or the second positioning structure;

an electromagnetic assembly for attracting the pin, such that the pin is separated from the first positioning structure or from the second positioning structure in a first direction; and a resilient member abutting against the pin and the electromagnetic assembly for driving the pin to move in a second direction opposite to the first direction, such that the pin inserts into the first positioning structure or the second positioning structure, so as to position the thermal print head module in the corresponding first position or the second position.

5. The fixing mechanism of claim 1, wherein a slot is formed on the linkage member for engaging with a shaft of the thermal print head module, such that the shaft moves along the slot when the thermal print head module drives the linkage member to rotate relative to the base.

6. A thermal sublimation printer, comprising:

a casing;

a thermal print head module pivoted to the casing; and a fixing mechanism for fixing a thermal print head module in different positions, the fixing mechanism comprising:

a base disposed on the casing;

a linkage member pivoted to the base and the thermal print head module, the linkage member being driven by the thermal print head module when the thermal print head module is rotated relative to the casing, such that the linkage member is pivoted to different positions relative to the base; and a plurality of positioning structures disposed on the linkage member for fixing the linkage member, so as to position the thermal print head module in the corresponding positions.

7. The thermal sublimation printer of claim 6, wherein the plurality of positioning structures comprises:

a first positioning structure for fixing the thermal print head module when the thermal print head module is rotated to a first position relative to the casing, so as to position the thermal print head module in the first position; and a second positioning structure for fixing the thermal print head module when the thermal print head module is rotated to a second position relative to the casing, so as to position the thermal print head module in the second position.

8. The thermal sublimation printer of claim 7, wherein the fixing mechanism further comprises:

a locking module disposed on the thermal print head module and rotating with the thermal print head module, the locking module being for fixing the thermal print head cooperatively with the first positioning structure when the thermal print head module is rotated to the first position relative to the casing, so as to position the thermal print head module in the first position, the locking module being further for fixing the thermal print head module cooperatively with the second positioning structure when the thermal print head module is rotated to the second position relative to the casing, so as to position the thermal print head module in the second position.

9. The thermal sublimation printer of claim 8, wherein the locking module comprises:

a pin for inserting into the first positioning structure or the second positioning structure;

an electromagnetic assembly for attracting the pin, such that the pin is separated from the first positioning structure or from the second positioning structure in a first direction; and a resilient member abutting against the pin and the electromagnetic assembly for driving the pin to move in a second direction opposite to the first direction, such that the pin inserts into the first positioning structure or the second positioning structure, so as to position the thermal print head module in the corresponding first position or the second position.

10. The thermal sublimation printer of claim 6, wherein the thermal print head module comprises a shaft, and a slot is formed on the linkage member for engaging with the shaft, such that the shaft moves along the slot when the thermal print head module drives the linkage member to rotate relative to the base.

* * * * *